US006622774B2

(12) United States Patent
Song

(10) Patent No.: US 6,622,774 B2
(45) Date of Patent: Sep. 23, 2003

(54) RAPID SOLIDIFICATION INVESTMENT CASTING

(75) Inventor: Shihong Gary Song, South Windsor, CT (US)

(73) Assignee: Hamilton Sundstrand Corporation, Rockford, IL (US)

( * ) Notice: Subject to any disclaimer, the term of this patent is extended or adjusted under 35 U.S.C. 154(b) by 0 days.

(21) Appl. No.: 10/008,912

(22) Filed: Dec. 6, 2001

(65) Prior Publication Data

US 2003/0106665 A1 Jun. 12, 2003

(51) Int. Cl.[7] ..... B22D 27/04

(52) U.S. Cl. ..... 164/128; 164/348; 164/458; 164/154.6

(58) Field of Search ..... 164/122.1, 126, 164/128

(56) References Cited

U.S. PATENT DOCUMENTS

| | | | | | |
|---|---|---|---|---|---|
| 2,968,848 | A | * | 1/1961 | Carter | 164/128 |
| 3,598,173 | A | | 8/1971 | Dore et al. | |
| 3,612,151 | A | | 10/1971 | Harrington et al. | |
| 3,763,926 | A | | 10/1973 | Tschinkel et al. | |
| 3,861,449 | A | * | 1/1975 | Barbero | 164/65 |
| 3,905,415 | A | | 9/1975 | Lefebvre | |
| 3,915,761 | A | | 10/1975 | Tschinkel et al. | |
| 3,939,895 | A | | 2/1976 | Sawyer | |
| 4,157,728 | A | | 6/1979 | Mitamura et al. | |
| 4,166,495 | A | | 9/1979 | Yu | |
| 4,190,094 | A | * | 2/1980 | Giamei | 164/122.1 |
| 4,593,745 | A | | 6/1986 | Yu et al. | |
| 4,607,679 | A | | 8/1986 | Tsai et al. | |
| 4,609,029 | A | | 9/1986 | Vishnevsky et al. | |
| 4,858,671 | A | | 8/1989 | Hesterberg et al. | |
| 5,522,448 | A | | 6/1996 | Righi | |
| 5,592,984 | A | | 1/1997 | Schmiedeknecht et al. | |
| 5,681,407 | A | | 10/1997 | Yu et al. | |
| 6,019,158 | A | | 2/2000 | Soderstrom et al. | |
| 6,239,082 | B1 | * | 5/2001 | Hewson et al. | 508/287 |
| 6,257,316 | B1 | * | 7/2001 | Vandermeer | 164/518 |
| 6,276,433 | B1 | | 8/2001 | Gigliotti, Jr. et al. | |
| 6,471,397 | B2 | * | 10/2002 | Soderstrom et al. | 374/139 |

OTHER PUBLICATIONS

Metals Handbook, Ninth Edition, ASM Handbook Committee, Apr. 1982, American Society for Metals, p. 145, 161–164, and 167.*

Physical Metallurgy Principles, Abbaschian, 1994, PWS Publishing Company, Third Edition, p. 458–459.*

* cited by examiner

*Primary Examiner*—M. Alexandra Elve
*Assistant Examiner*—Kevin McHenry
(74) *Attorney, Agent, or Firm*—Carlson, Gaskey & Olds

(57) ABSTRACT

An investment casting process utilizes rapid cooling during solidification to achieve a desired final microstructure. A molten high temperature aluminum alloy is poured into a ceramic shell mold. The ceramic shell mold is then lowered into an oil bath held in a quenching tank to rapidly cool the molten material. Thus, solidification takes place quickly via rapid extraction of the latent heat of the metal by the quenching oil bath. The rapid solidification achieves a uniform fine microstructure in an as-cast component.

18 Claims, 2 Drawing Sheets

RAPID SOLIDIFICATION INVESTMENT CASTING

BACKGROUND OF THE INVENTION

This invention relates to an investment casting method that utilizes rapid cooling during solidification to achieve a desired uniform fine microstructure for an as-cast component.

Investment casting is typically used to produce parts having complex shapes that are cost prohibitive to produce by other casting methods or which cannot be made by other methods such as sand or permanent mold casting. During the investment casting process, molten metal is poured into a pre-heated ceramic shell mold. A known characteristic of the ceramic shell mold used in investment casting is slow solidification. Slow solidification produces a coarse and heterogeneous casting microstructure. When conventional aluminum alloys are cast, this coarse and heterogeneous microstructure is acceptable because the microstructure for the final product can be altered to a desired microstructure by post-casting heat treatment.

Slow solidification becomes disadvantageous when the cast alloy needs to be used in an as-cast form and fast cooling rates are required to achieve the desired uniform fine microstructure. This is particularly true when dispersion strengthened alloys are processed via casting methods. For example, when cast high temperature aluminum alloys are used in an as-cast state, or with minimal post-casting heat treatment to produce aircraft engine parts, rapid cooling during solidification is a crucial part of achieving the desired as-cast microstructure.

Thus, it is desirable to provide an improved investment casting process that accommodates fast cooling of the casting during solidification while using conventional investment casting ceramic shell molds. It is also desirable for the improved investment casting process to be easily incorporated into existing foundry facilities in addition to overcoming the above referenced deficiencies.

SUMMARY OF THE INVENTION

The subject invention provides an investment casting process that permits rapid cooling of the casting while using conventional ceramic shell molds. Molten material is poured into the pre-heated ceramic shell mold. The mold is then rapid cooled by quenching the shell mold in an oil bath.

In the preferred embodiment, the molten material is a high temperature aluminum alloy having a melting point temperature approximately between 600 to 700° C. Prior to quenching the mold in the oil bath, the molten material is preferably maintained at a temperature approximately between 50 to 100° C. above the melting point temperature. The oil preferably has a flash point greater than the melting point temperature of the aluminum alloy and has a low viscosity at room temperature.

The cooling rate can be specifically tailored to various component types/shapes by controlling/varying the immersion rate of the shell mold into the oil bath. Cooling rate can also be controlled by varying the type of oil, e.g., oils having different flash points and viscosities, or by varying the temperature of the oil. Cooling rate is also a function of the thickness and permeability of the shell mold.

The subject invention provides an improved investment casting process that utilizes rapid cooling during solidification to achieve a desired final as-cast microstructure. These and other features of the present invention can be best understood from the following specification and drawings, the following of which is a brief description.

DETAILED DESCRIPTION OF AN EXEMPLARY EMBODIMENT

A unique investment casting method and apparatus is shown in FIGS. 1–5. The subject investment casting process utilizes rapid cooling during solidification to achieve a desired uniform fine microstructure in an as-cast component. Preferably, the subject casting process is used to produce as-cast aircraft engine components, however, other component types can also be produced with the subject process.

Figure 1:
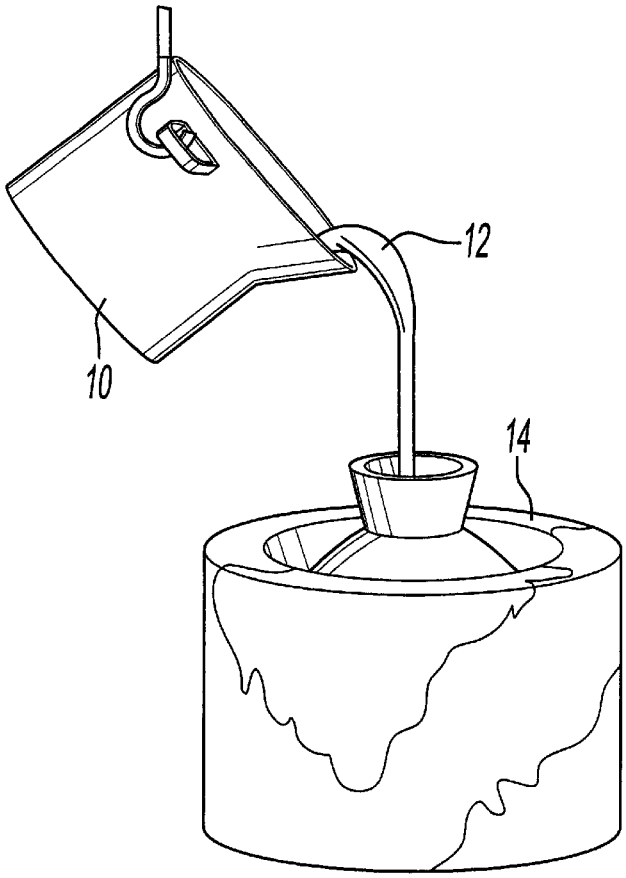
FIG. 1 is a schematic view that depicts the pouring of molten material into a mold.
Figure 2:
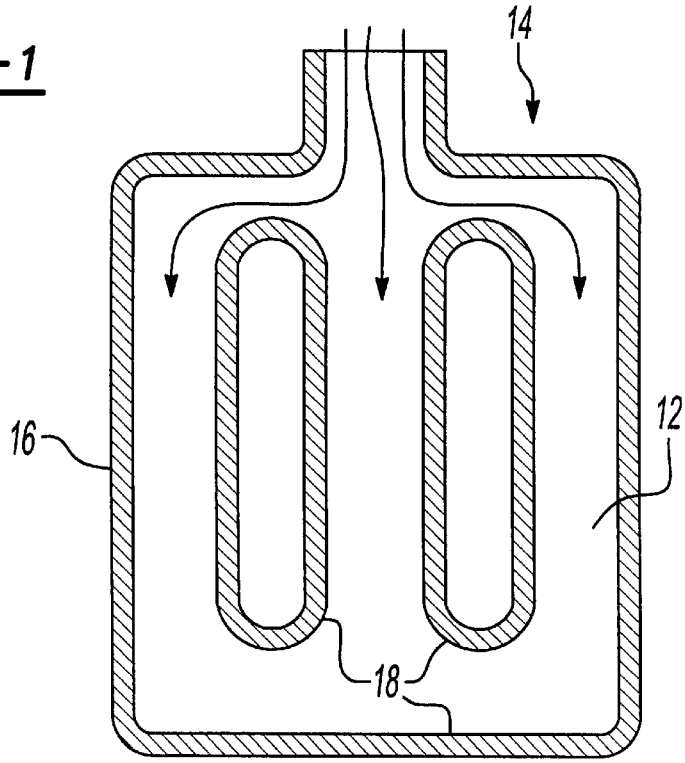
FIG. 2 is a schematic view cross-sectional view of a ceramic shell mold.
Figure 3:
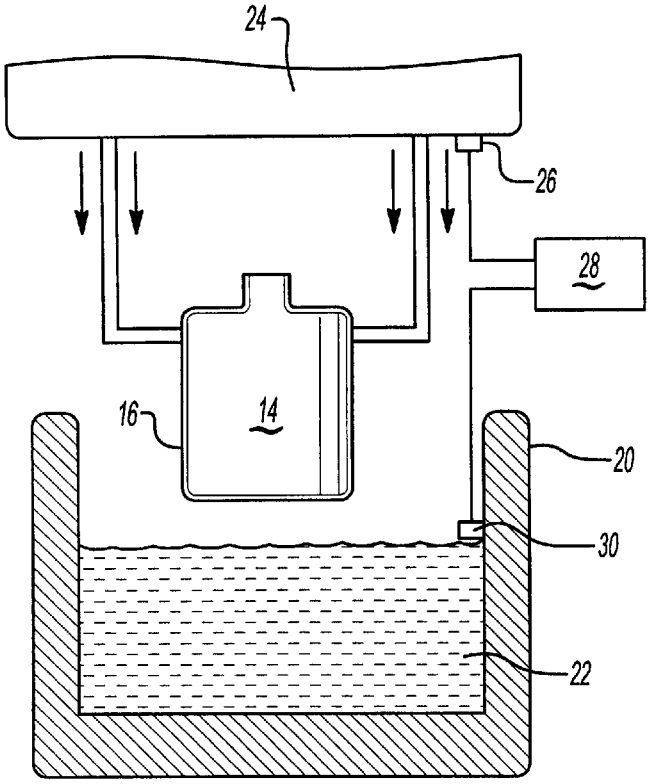
FIG. 3 is a schematic view that depicts the mold of FIG. 1 being lowered into a quenching tank.

As shown in FIG. 1, a ladle 10 is used to pour a molten material 12 into a pre-heated conventional ceramic shell mold 14. The ceramic shell molds used in investment casting methods are well known in the art and will not be discussed in further detail. Preferably, the molten material 12 is a high temperature aluminum alloy that has a melting point temperature approximately between 600 to 700° C. While an aluminum alloy is preferred, other similar materials known in the art could also be used.

The mold 14 has an outer surface 16 and an inner structure 18 that defines a desired shape for a component. As the molten material 12 is poured into the mold 14 it flows around the inner structure 18 and fills the mold 14 to form the component.

The mold 14 is lowered into a quenching tank 20, which is used to hold a predetermined amount of oil or other similar fluid 22. Preferably, the oil 22 has a high flash point and has a low viscosity at room temperature. The flash point is the lowest temperature at which vapors above a volatile combustible substance ignite in air when exposed to flame. Preferably, the flash point of the quenching oil 22 is greater than the melting point temperature of the molten material 12.

A lowering mechanism 24 is used to immerse the mold 14 in the oil 22 at a predetermined immersion speed. The immersion speed controls the cooling rate and can be a constant speed or can a variable speed depending upon the desired cooling rate for a specific component. A sensor or other similar detection mechanism 26 can be used to monitor the immersion speed and a central processing unit (CPU) 28 can generate a control signal to control the immersion speed. Optionally, manual control can be used for immersion of the mold 14 into the tank 20.

Figure 4:
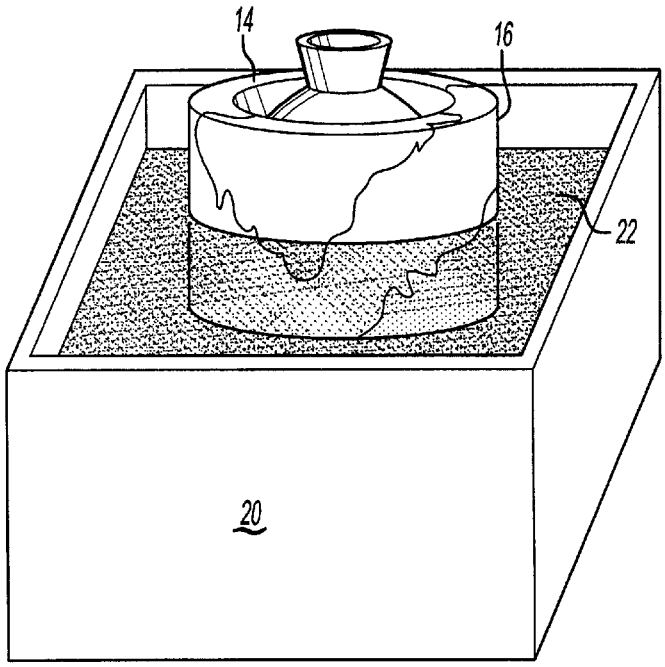
FIG. 4 is a schematic view that depicts the mold of FIG. 3 immersed in oil.

As the mold 14 is lowered into the quenching oil 22, the outer surface 16 of the mold 14 is surrounded by the oil 22 as shown in FIG. 4. The oil 22 penetrates the mold and contacts the molten material 12 to rapidly cool the component. The mold 14 can be completely immersed within the oil 22 or only partly immersed depending upon the cooling rate required. Additionally, the oil 22 can be stirred either manually or in an automated manner to achieve a desired cooling rate. Stirring the oil 22 allows heated oil 22 in the immediate vicinity of the mold 14 to be moved away from the mold 14 and be replaced by cooler oil 22.

Another factor that affects the cooling rate is the temperature of the oil 22. The initial temperature of the quenching oil 22 can be adjusted depending on the quenching power needed for solidification. A temperature sensor or other similar monitoring mechanism 30 can be used to monitor the temperature of the oil 22. The CPU 28 can then use the oil temperature information to determine whether the oil 22 is at the desired temperature to produce the desired quenching power.

Quenching power can also be further adjusted by selecting from a variety of quenching fluids of different cooling power. Two of the important cooling characteristics for fluids are viscosity and evaporative capability. Preferably oil with a high flash point and a low viscosity at room temperature is used as the quenching oil 22. Low viscosity oils are preferred because they have better wetting properties and penetrate the ceramic shell mold 14 more efficiently then high viscosity oils. Additionally, evaporative capability is important because too much evaporation can affect the surface finish of the component. For example, water is too evaporative and produces a significant amount of steam when the mold 14 is immersed in the water. The steam penetrates the mold 14 and produces localized pressure forces that affect the metal alloy as it solidifies resulting in a non-smooth surface. On the other hand, the fluid must provide sufficient evaporation to produce the desired cooling rate. Thus, quenching oils are preferred, as indicated above. The preferred type of quenching oil is either Farbest Corporation's quenching oil #1 or Castrol Industrial East, Incorporated quenching oil, however other similar oils could also be used.

The temperature at which the molten material 12 is when the molten material 12 is poured into the pre-heated mold 14 also affects quenching power. If the temperature of the molten metal 12 is too high, i.e. the molten material 12 is superheated, then more quenching power is needed for rapid cooling. Preferably, the molten material 12 is heated to a temperature slightly greater than the melting temperature of the material 12 prior to quenching. The mold 14 can be preheated to assist in maintaining the molten material 12 at the desired temperature prior to quenching. Preferably, the molten material 12 is maintained at 50 to 100° C. above the melting temperature prior to quenching.

Thickness and permeability of the shell mold 14 also affects the cooling rate. Effective heat transfer occurs as a result of direct contact of quenching oil with the molten material 12 in the mold 14. Thin wall thickness in the mold 14 and high mold permeability facilitate rapid cooling, however, the mold 14 must be strong enough to avoid cracking. Reduced wall thickness and enhanced mold permeability can lead to decreased mold strength. The mold 14 is designed to maintain a proper balance between mold strength and cooling power requirements. One factor that affects mold thickness is the weight of the component being produced. Thus, mold thickness is a function of component weight, i.e. a heavy component requires a thicker mold than a lighter component.

Figure 5:
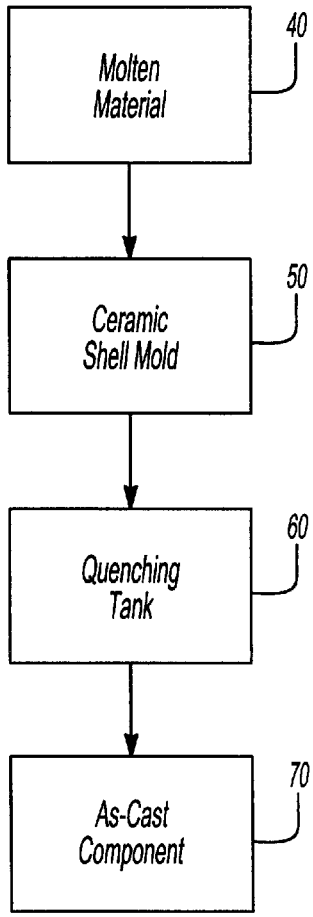
FIG. 5 is a flowchart of the subject invention.

The steps for the unique investment casting method used to produce an as-cast component having a desired final microstructure are outlined in FIG. 5. The metal alloy is melted and maintained at a desired temperature, indicated at step 40. The molten metal alloy 12 is then poured into a pre-heated ceramic shell mold 14 as indicated at step 50. The ceramic shell mold 14 is lowered into a quenching tank 20 as indicated at step 60. The mold 14 is lowered at a predetermined immersion rate to produce a desired final microstructure for the as-cast component as indicated at step 70.

Additional steps include filling the quenching tank 20 with a quenching oil that has a flash point above the melting temperature of the molten metal alloy 12 and which also has a low viscosity at room temperature. The molten metal alloy 12 is preferably maintained at a temperature that is 50 to 100° C. above the melting point of the molten metal ally 12 prior to quenching. This unique process provides rapid cooling during solidification of a high temperature alloy in a traditional investment casting ceramic shell mold to produce an as-cast component having a desired uniform and fine microstructure.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

I claim:

1. A method for producing a cast component comprising the steps of:

(a) pouring a molten material into a ceramic shell mold; and (b) immersing the ceramic shell mold in oil to produce a desired final microstructure for the cast component wherein the oil has a high flash point temperature and low viscosity at room temperature with the flash point temperature being greater than the melting temperature of the molten material.

2. A method according to claim 1 including maintaining the molten material at 50 to 100° C. above the melting point of the molten material prior to step (b).

3. A method according to claim 1 wherein the molten material comprises a high temperature aluminum alloy having a melting point approximately between 600 to 700° C.

4. A method according to claim 1 wherein step (b) further includes controlling temperature of the oil to provide a predetermined quenching power.

5. A method according to claim 1 further including having the oil at room temperature prior to step (b).

6. A method according to claim 1 wherein step (b) further includes controlling immersion speed of the ceramic shell mold into the oil to control the cooling rate of the molten material.

7. A method according to claim 1 including the step of controlling ceramic shell mold wall thickness as a function of weight of the component being cast prior to step (a).

8. An investment casting method for producing an as-cast component having a desired final microstructure comprising the steps of:

(a) pouring a molten metal alloy into a ceramic shell mold; and (b) lowering the ceramic shell mold into a fluid bath at a predetermined immersion rate to produce a desired final microstructure for the as-cast component wherein the fluid is oil that has a flash point above the melting temperature of the molten metal alloy and a low viscosity at room temperature.

9. A method according to claim 8 including having the molten metal alloy at 50 to 100° C. above the melting point of the molten metal ally prior to step (b).

10. A method according to claim 9 including varying temperature of the oil during step (b) to achieve a desired cooling rate over time.

11. A method according to claim 10 including varying the immersion rate during step (b) to achieve a desired cooling rate over time.

12. A method according to claim 11 including the step of controlling ceramic shell mold wall thickness as a function of weight of the component being cast prior to step (a).

13. A method according to claim 12 wherein the molten metal alloy is a high temperature aluminum alloy having a melting point temperature approximately between 600 to 700° C.

14. An investment casting system for producing an as-cast component having a desired final microstructure comprising:

a ceramic shell mold having an outer surface and an internal structure defining a desired shape of a component;

a ladle for pouring a molten material into said internal structure to form said component;

a quenching tank wherein said ceramic shell mold is lowered into said quenching tank by a mold moving mechanism; and a predetermined amount of oil held within said quenching tank and having a flash point temperature higher than the melting temperature of said molten material wherein said outer surface of said ceramic shell mold interacts with said oil as said mold moving mechanism lowers said ceramic shell mold into said quenching tank to rapidly cool said molten material during solidification to achieve a desired final as-cast microstructure in said component.

15. A system according to claim 14 wherein said internal structure is defined by a variable wall thickness and wherein said wall thickness are variable between different component types as a function of component weight.

16. A system according to claim 14 including a central controller for generating a control signal that is communicated to said mold moving mechanism to lower said ceramic shell mold into said oil at a predetermined immersion rate.

17. A system according to claim 16 including a sensor for measuring immersion speed of said ceramic shell mold into said oil and generating a sensor signal representative of said immersion speed wherein said sensor signal is transmitted to said central controller.

18. A system according to claim 14 including a sensor for measuring oil temperature and generating a sensor signal representative of said oil temperature wherein said sensor signal is transmitted to a central controller.

* * * * *